United States Patent [19]

Dawson

[11] 4,096,780

[45] Jun. 27, 1978

[54] STEREOPHONIC ELECTROMAGNETIC PICKUP DEVICE FOR STRINGED MUSICAL INSTRUMENTS

[76] Inventor: Lorna Ann Dawson, 12 Grove Rd., Pinner, Middlesex, England

[21] Appl. No.: 753,734

[22] Filed: Dec. 23, 1976

[51] Int. Cl.[2] ..... G10H 3/08

[52] U.S. Cl. ..... 84/1.16; 84/1.15; 84/DIG. 27

[58] Field of Search ..... 84/1.01, 1.14–1.16, 84/DIG. 27; 179/1 G, 1 M

[56] References Cited

U.S. PATENT DOCUMENTS

| | | | |
|---|---|---|---|
| 3,290,424 | 12/1966 | Fender | 84/1.16 |
| 3,602,627 | 8/1971 | McCammon | 84/1.16 |
| 3,649,737 | 3/1972 | Jespersen | 84/1.15 |
| 3,673,304 | 6/1972 | Dudas | 84/1.01 |
| 3,715,446 | 2/1913 | Kosinski | 84/1.15 |
| 3,742,113 | 6/1973 | Cohen | 84/1.04 |
| 3,915,048 | 10/1975 | Stich | 84/1.14 |
| 4,010,668 | 3/1977 | Plueddemann | 84/1.16 |

FOREIGN PATENT DOCUMENTS

| | | | |
|---|---|---|---|
| 2,413,081 | 10/1975 | Germany | 84/1.16 |

*Primary Examiner*—B. Dobeck
*Assistant Examiner*—Vit W. Miska
*Attorney, Agent, or Firm*—Blanchard, Flynn, Thiel, Boutell & Tanis

[57] ABSTRACT

An electric guitar with steel strings feeds into a stereophonic amplifier and loudspeaker system with two channels and is fitted with a pickup which senses each guitar string individually and proportions the signals from each string differently, so that each guitar string sounds from the loudspeakers as though that string is in a different position from all the other strings. For each guitar string the pickup has a respective pair of coils of varying numbers of turns and a respective permanent magnet. Electrical connections to the coils enable one channel to receive a signal from one coil of each pair and the other channel to receive a signal from the other coil of each pair, so that there are two composite signals, one per channel.

10 Claims, 5 Drawing Figures

FIG. 1.
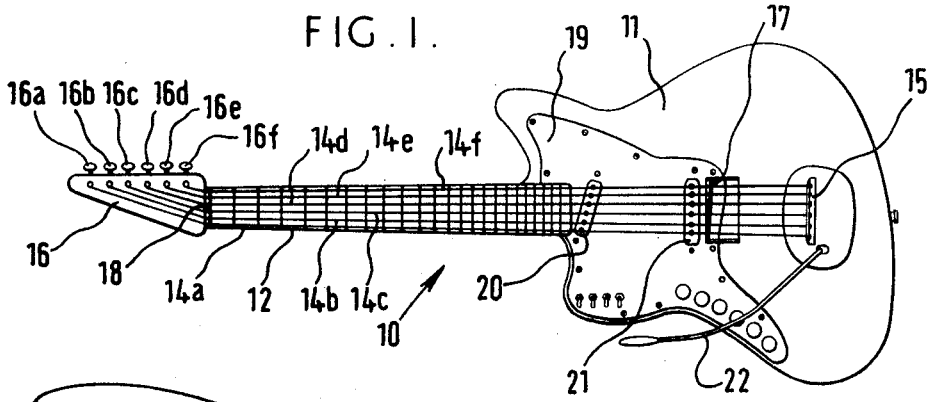
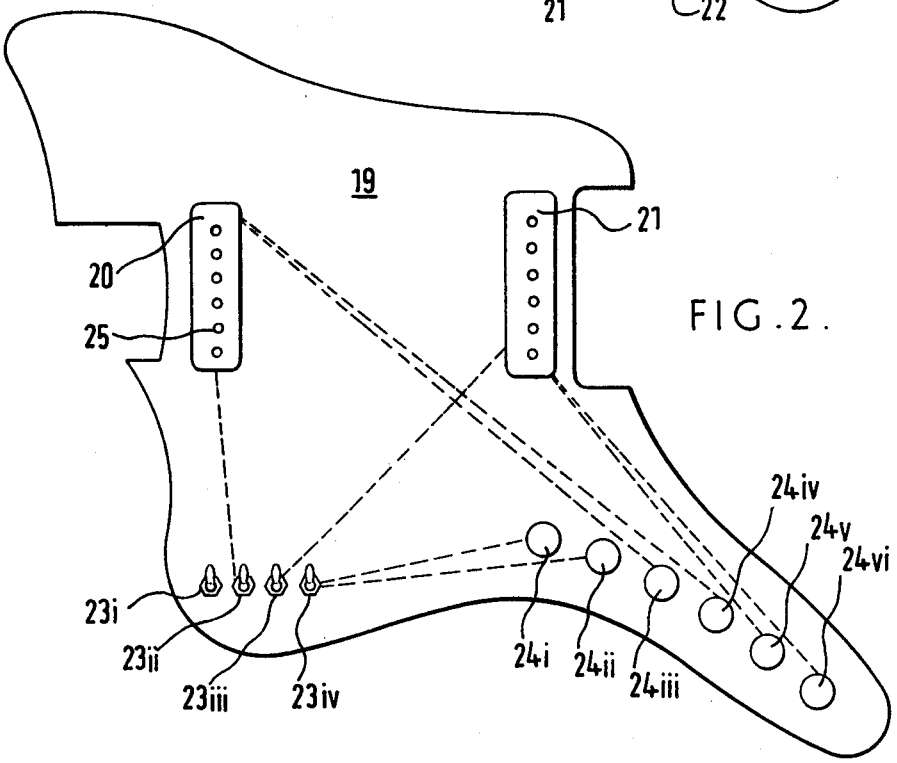
FIG. 2.
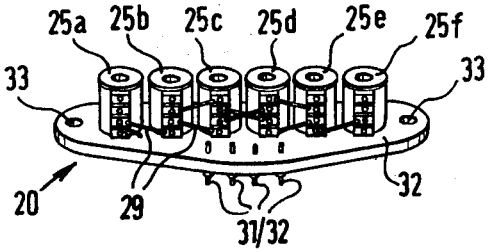
FIG. 3.

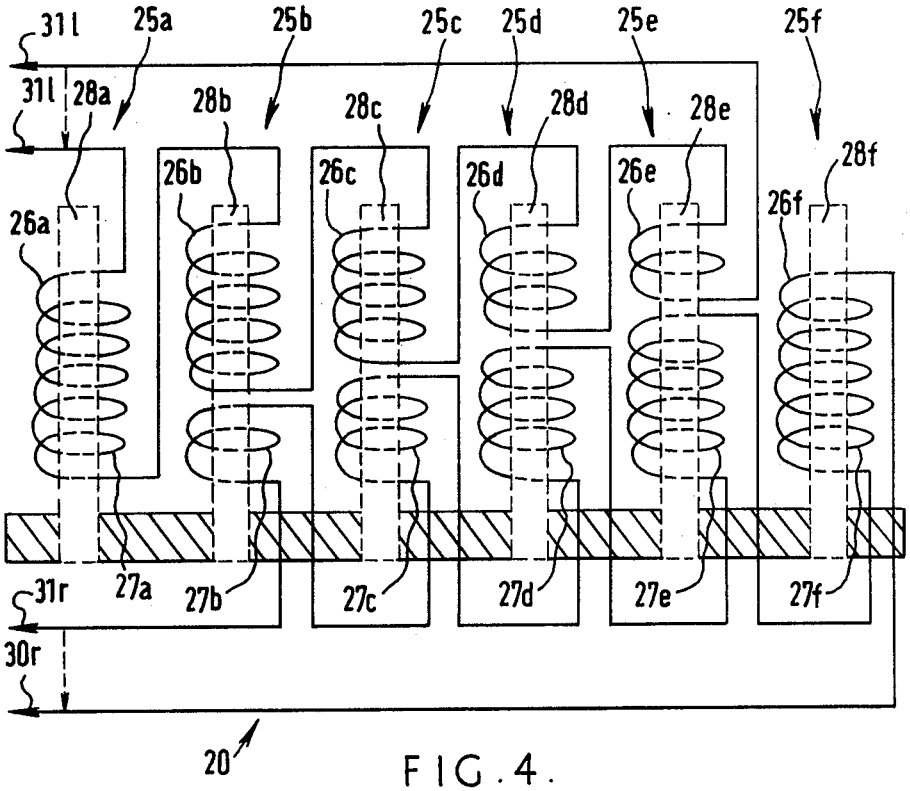
FIG. 4.
FIG. 5.
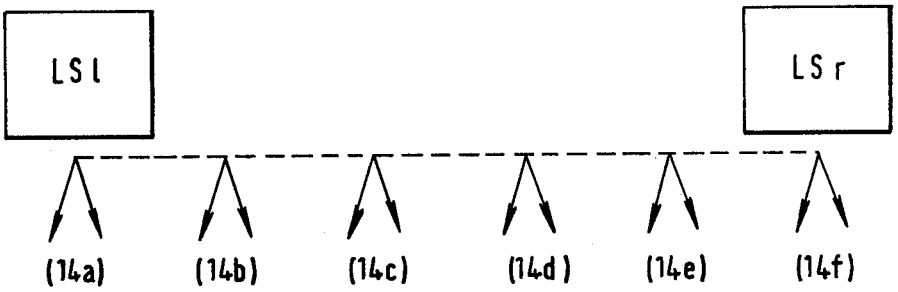

STEREOPHONIC ELECTROMAGNETIC PICKUP DEVICE FOR STRINGED MUSICAL INSTRUMENTS

BACKGROUND OF THE INVENTION

1. Field of the Invention

This invention relates generally to electrically amplified multi-stringed musical instruments, for instance electric guitars, and more particularly to a polyphonic for instance, stereophonic pickup device for use with a multi-stringed musical instrument of which the strings are of ferromagnetic material, for instance, steel.

2. Description of the Prior Art

Known stereophonic pickup devices consist of a number of permanent magnets arranged to create a magnetic field, through which the steel strings of the musical instrument pass. The magnets are divided into two groups, each group of magnets being associated with a coil, the output voltage induced across which being applied to each of two stereophonic amplifier channels, to achieve complete separation of the signals induced by each group of magnets.

SUMMARY

The present invention provides a polyphonic pickup device for use with a stringed musical instrument of a type having an instrument body, a plurality of strings of ferromagnetic material, means for suspending said strings under tension from two spaced portions of the instrument body and means for individually adjusting the tension in each string so as to adjust the musical pitch of that string, the pickup device comprising: a support; a plurality of groups of electric coils mounted to the support, the number of groups of said coils corresponding to the number of strings of the musical instrument, each group of coils being spaced apart from the other groups of coils; a plurality of spaced-apart permanent magnets mounted to the support and corresponding in number to the number of groups of said coils and hence to the number of said strings; each group of coils being positioned close to an associated one of the said megnets so as to be in the magnetic field thereof; first electrical connections between a first coil of each group of coils; second electrical connections between a second coil of each group of coils; the ratio of the number of turns in the first coil to the number of turns in the second coil being different for each group of coils; means for mounting the support to the instrument body to place each string in the magnetic field of a respective one of the said magnets; means for producing as a first electrical output signal a combination of electric signals from said first coils resulting from vibration of said strings; and means for producing as a second electrical output signal a combination of electric signals from said second coils resulting from vibration of said strings; whereby polyphonic reproduction of said first and second electrical output signals produces an aural effect as if the individual strings of the musical instrument are widely spaced apart.

IN THE DRAWINGS

FIG. 1 illustrates an electric guitar including a stereophonic pickup device embodying the invention;

FIG. 2 is an enlarged view of part of the guitar of FIG. 1, showing the pickup device and controls of the guitar;

FIG. 3 is a pictorial view of the pcikup device;

FIG. 4 is a diagrammatic illustration of the pickup device; and

FIG. 5 illustrates the aural effect of the electric guitar.

DESCRIPTION OF THE PREFERRED EMBODIMENT

Referring to FIG. 1, there is illustrated an electric guitar which is of conventional construction, apart from incorporating a stereophonic pickup device in accordance with the invention. More particularly, the guitar 10 comprises a body 11, a neck 12 which is an extension of the body 11, and a head 13. Six strings 14*a* to 14*f* of steel extend from a tailpiece 15, over a bridge 17 and nut 18 to tuning machines 16*a* to 16*f* as shown. A scratch plate or finger plate 19 is secured to the body 11, and carries two pickups, namely, a finger plate pickup 20 which embodies the invention, and a bridge pickup 21, which may either be identical to the pickup 20 or may be a conventional pickup such as the known pickup referred to above. A tremelo arm 22 extends out of the tailpiece 15, and an electric flex (not shown) is provided for connection to a stereophonic amplifier (not shown) of conventional construction. Four selector switches 23i to 23iv are mounted on the finger plate 19, for mono/stereo selection, finger plate pickup 20 selection, bridge pickup 21 selection and rhythm/lead selection respectively. The terms "rhythm" and "lead" are terms of art which will be understood by those who are familiar with the known electric guitar, and with groups of musicians using electric guitars. Six volume controls 24i to 24vi are also mounted on the finger plate 19. Controls 24i and 24ii are rhythm volume controls for the right-hand and left-hand channels respectively. Controls 24iii and 24iv are finger plate pickup 20 volume controls for the right-hand and left-hand channels. Controls 24v and 24vi are bridge pickup volume controls for the right-hand and left-hand channels respectively.

Describing the finger plate pickup 20 in more detail, with reference to FIGS. 3 and 4, the pickup 20 comprises six coil and magnetic assemblies 25*a* to 25*f*, corresponding respectively to six strings 14*a* to 14*f*, which are respectively tuned to bottom E, A, D, G, B and top E, by adjustment of the tuning machines 16*a* to 16*f*, the natural frequency of each one of the strings 14*a* to 14*f*, individually depending upon the tension of the string and the distance between the bridge 17 and the nut 18, as well as upon the thickness or mass per unit length of each string.

Each of the coil and magnet assemblies 25*a* to 25*e* comprises a respective coil 26*a* to 26*e*, the five coils 26*a* to 26*e* being connected in series as shown for providing a composite electrical signal on leads 31L and 31L for the left-hand channel of the amplifier (not shown). Each of the coil magnet assemblies 25*b* to 25*f* comprises a respective coil 27*b* to 27*f*, the coils 27*b* to 27*f* being connected in series as shown for providing a composite electrical signal on leads 30*r* and 31*r* for the right-hand channel of the amplifier. Finally, each of the coil and magnet assemblies 25*a* to 25*f* comprises a respective permanent bar magnet 28*a* to 28*f*, each bar magnet 28*a* to 28*f* extending through the respective coil or coils 26 and 27 of the coil and magnet assemblies 25. The total number of turns in the coil or coils of each assembly 25 is approximately the same, but it will be appreciated that the ratios vary from assembly to assembly, with the result that the assembly 25*a* produces no signal on the right-hand channel, the assembly 25*f* produces no signal on the left-hand channel, whilst the assemblies 25b to 25e produce a progressively increasing signal on the right-hand channel and progressively decreasing signal on the left-hand channel, due to having a progressively decreasing number of turns in the coils 26b to 26e and a progressively increasing number of turns on the coils 27b to 27e.

The pickup 20 comprises a support 32 having two holes 33 for screws (not shown) for securing the pickup device 20 to the finger plate 19. Thus secured, each of the coil and magnet assemblies 25a to 25f is located underneath and closely adjacent a corresponding one of the strings 14a to 14f, with the result that vibration of any one of the strings 14a to 14f will produce an output in the resepctive coil 25 and/or the respective coil 26 (assembly 25a having no coil 27, assembly 25f having no coil 26, as explained above).

It will be appreciated that the effect of using the finger plate pickup 20 is that reproduction of the sound through left-hand and right-hand loudspeakers LS*l* and LS*r* (FIG. 5) will result in the spacial separation of the apparent sources of sound corresponding respectively to the six strings 14a to 14f as shown, sound from string 14a coming only from left-hand speaker LS*l*, the sound from string 14f coming only from right-hand speaker LS*r* and the sound from the other strings 14b to 14e being spaced apart as shown in FIG. 5. Of course, although the strings themselves are tuned respectively to bottom E, A, D, G, B and top E, it will be realised that a person playing the guitar 10 can change the actual note produced by each string in the conventional manner. Accordingly, although the position of the apparent source of sound of each string in FIG. 5 remains unchanged, the actual pitch will depend upon the player.

The invention may be applied to a polyphonic system other than stereo, for example, three or four channel systems, with a corresponding increase in the number of coils in each magnet and coil assembly 25. Instead of being connected in series for each channel, the coils may be connected in parallel, depending upon the electrical characteristics of the complete system.

I claim:

1. A polyphonic pickup device for use with a stringed musical instrument of a type having an instrument body, a plurality of strings of ferromagnetic material, means for suspending said strings under tension from two spaced portions of the instrument body and means for individually adjusting the tension in each string so as to adjust the musical pitch of that string, the pick-up device comprising:

a support;

a plurality of groups of electric coils mounted to the support, the number of groups of said coils corresponding to the number of strings of the musical instrument, each group of coils being spaced apart from the other groups of coils, several of said groups having at least first and second coils;

a plurality of spaced-apart permanent magnets mounted to the support and corresponding in number to the number of groups of said coils and hence to the number of said strings; each group of coils being positioned close to an associated one of the said magnets so as to be in the magnetic field thereof;

first electrical connections between said first coils of said groups of coils;

second electrical connections between said second coils of said groups of coils;

the ratio of the number of turns in the first coil to the number of turns in the second coil being different for each group of coils;

means for mounting the support to the instrument body to place each string in the magnetic field of a respective one of the said magnets;

means for producing as a first electrical output signal a combination of electric signals from said first coils resulting from vibration of said strings;

and means for producing as a second electrical output signal a combination of electric signals from said second coils resulting from vibration of said strings;

whereby polyphonic reproduction of said first and second electrical output signals produces an aural effect as if the individual strings of the musical instrument are widely spaced apart.

2. A pickup device as defined in claim 1 wherein the total number of turns in each group of coils is the same.

3. A pickup device as defined in claim 1 wherein said first electrical connections connect said first coils in series with each other and wherein said second electrical connections connect said second coils in series with each other.

4. A pickup device as defined in claim 1 wherein the groups of coils and the permanent magnets are each six in number and are arranged on the support to underlie guitar strings.

5. A pickup device as defined in claim 1 wherein the number of coils in each group is two for stereophonic reproduction.

6. In a stringed musical instrument having an instrument body, a plurality of strings of ferromagnetic material, means for suspending said strings under tension from two spaced portions of the instrument body and means for individually adjusting the tension in each string so as to adjust the musical pitch of that string, the provision of a polyphonic pickup device comprising:

a support;

a plurality of groups of electric coils mounted to the support, the number of groups of said coils corresponding to the number of strings of the musical instrument, each group of coils being spaced apart from other groups of coils, several of said groups having at least first and second coils.

a plurality of spaced-apart permanent magnets mounted to the support and corresponding in number to the number of groups of said coils and hence to the number of said strings; each group of coils being positioned close to an associated one of the said magnets so as to be in the magnetic field thereof;

first electrical connections between said first coils of said groups of coils;

second electrical connections between said second coils of said groups of coils;

the ratio of the number of turns in the first coil to the number of turns in the second coil being different for each group of coils;

means mounting the support to the instrument body and placing each string in the magnetic field of a respective one of the said magnets;

means for producing as a first electrical output signal a combination of electric signals from said first coils resulting from vibration of said strings;

and means for producing as a second electrical output signal a combination of electric signals from said second coils resulting from vibration of said strings;

whereby polyphonic reproduction of said first and second electrical output signals produces an aural effect as if the individual strings of the musical instrument are widely spaced apart.

7. The combination as defined claim 6 wherein the total number of turns in each group of coils is the same.

8. The combination as defined in claim 6 wherein said first electrical connections connect said first coils in series with each other and wherein said second electrical connections connect said second coils in series with each other.

9. The combination as defined in claim 6 wherein the musical instrument is a six-stringed electric guitar and the groups of coils and the permanent magnets are each six in number and underlie the guitar strings.

10. The combination as defined in claim 7 wherein said first electrical connections connect said first coils in series with each other and wherein said second electrical connections connect said second coils in series with each other and wherein the musical instrument is a six-stringed electric guitar and the groups of coils and the permanent magnets are each six in number and underlie the guitar strings.

* * * * *